US010927789B2

(12) United States Patent
Yamaguchi et al.

(10) Patent No.: US 10,927,789 B2
(45) Date of Patent: Feb. 23, 2021

(54) STRATIFIED SCAVENGING ENGINE AND PORTABLE WORK MACHINE

(71) Applicant: YAMABIKO CORPORATION, Tokyo (JP)

(72) Inventors: Shiro Yamaguchi, Tokyo (JP); Ken Shirai, Tokyo (JP); Tetsuya Isogai, Tokyo (JP)

(73) Assignee: YAMABIKO CORPORATION, Tokyo (JP)

( * ) Notice: Subject to any disclaimer, the term of this patent is extended or adjusted under 35 U.S.C. 154(b) by 0 days.

(21) Appl. No.: 16/553,425

(22) Filed: Aug. 28, 2019

(65) Prior Publication Data

US 2020/0095953 A1 Mar. 26, 2020

(30) Foreign Application Priority Data

Sep. 26, 2018 (JP) ..... JP2018-180728

(51) Int. Cl.

| | |
|---|---|
| ***F02F 3/24*** | (2006.01) |
| ***F02F 1/22*** | (2006.01) |
| ***F02B 25/14*** | (2006.01) |
| ***F02B 63/02*** | (2006.01) |
| ***F02B 75/02*** | (2006.01) |

(Continued)

(52) U.S. Cl.

CPC ..... *F02F 3/24* (2013.01); *F02B 25/14* (2013.01); *F02B 25/18* (2013.01); *F02B 63/02* (2013.01); *F02B 75/02* (2013.01); *F02F 1/22* (2013.01); *F02F 7/0036* (2013.01); *F02B 2075/025* (2013.01); *F02B 2710/036* (2013.01)

(58) Field of Classification Search

CPC ... F02F 3/24; F02F 1/22; F02F 7/0036; F02B 25/14; F02B 63/02; F02B 75/02; F02B 2075/025; F02B 25/16; F02B 25/18; F02B 29/00; F02B 2700/037; F02B 2710/036

See application file for complete search history.

(56) References Cited

U.S. PATENT DOCUMENTS 5,628,295 A * 5/1997 Todero ..... F02B 25/14 123/568.13
2005/0045124 A1* 3/2005 Amend ..... F02B 33/04 123/73 AA (Continued)

FOREIGN PATENT DOCUMENTS

JP 4286679 B2 7/2009

OTHER PUBLICATIONS

European Search Report for Corresponding European Application No. 19199228.8 (3 Pages) (dated Feb. 6, 2020).

*Primary Examiner* — Jacob M Amick
(74) *Attorney, Agent, or Firm* — Lucas & Mercanti, LLP

(57) ABSTRACT

Provided is a stratified scavenging engine and a portable work machine that suppress THC sufficiently. A stratified scavenging engine includes: a cylinder having a cylinder bore; and a piston stored in the cylinder bore to be movable in a reciprocating manner. The cylinder has an intake port to intake leading air and a scavenging port to scavenge combustion gas, the intake port and the scavenging port being open to the cylinder bore. The piston has a peripheral surface including a piston groove to guide leading air from the intake port to the scavenging port, and the piston groove has a recess near the intake port.

9 Claims, 9 Drawing Sheets

(51) Int. Cl.
*F02F 7/00* (2006.01)
*F02B 25/18* (2006.01)

(56) References Cited

U.S. PATENT DOCUMENTS

| | | | | |
|---|---|---|---|---|
| 2012/0145137 | A1* | 6/2012 | Shirai | F02B 25/18<br>123/73 R |
| 2015/0219007 | A1* | 8/2015 | Mavinahally | F02B 33/04<br>123/73 AA |
| 2016/0097344 | A1* | 4/2016 | Yamazaki | F02F 3/24<br>123/73 PP |
| 2018/0080369 | A1* | 3/2018 | Lundgren | F02D 9/02 |

* cited by examiner

STRATIFIED SCAVENGING ENGINE AND PORTABLE WORK MACHINE

CROSS REFERENCE TO RELATED APPLICATIONS

This application claims the benefit of priority from Japanese patent application No. JP 2018-180728 filed on Sep. 26, 2018, the contents of which are hereby incorporated by reference.

BACKGROUND

Technical Field

The present invention relates to stratified scavenging engines and portable work machines including such a stratified scavenging engine.

Background Art

Two-stroke engines are often used in portable work machines, such as power blowers, brush cutters and chain saws. Such a two-stroke engine includes a scavenging channel that connects a crank chamber with a combustion chamber. The scavenging channel feeds air-fuel mixture in the crank chamber to the combustion chamber, and the air-fuel mixture scavenges exhaust gas in the combustion chamber. This type of two-stroke engine has been required to reduce the exhaust gas emissions, particularly to reduce THC (Total Hydro Carbon) that is a blow-by of air-fuel mixture (new gas). To this end, stratified scavenging engines are in practical use, and they are configured to let leading air firstly and air-fuel mixture secondly flow into the combustion chamber in a stratified manner so as to suppress blow-by of the air-fuel mixture.

Such a stratified scavenging engine has a piston groove on the peripheral surface of the piston. This piston groove guides leading air from the intake port to the scavenging port that is the exit of the scavenging channel. Leading air flows into the scavenging port on the downstream of the scavenging channel, and air-fuel mixture in the crank chamber flows into the upstream of the scavenging channel. The leading air on the downstream firstly flows into the combustion chamber to scavenge the combustion gas. Such a stratified scavenging engine sends the leading air sucked through the intake port to the scavenging port via the piston groove during ascending of the piston. Since the piston groove has a gently curved bottom face, the leading air returns to the piston groove from the scavenging port during descending of the piston, which causes blow-back of the leading air to the intake port.

JP 4286679 B2, for example, proposes a stratified scavenging engine configured to suppress the blow-back of the leading air to the intake port. The stratified scavenging engine described in JP 4286679 B2 has a protrusion partially protruding from the bottom face of the piston groove. This protrusion of the piston groove protrudes at a substantially middle position in the extending direction of the piston groove so as to partially block the leading air flowing from the scavenging port to the intake port. The protrusion blocks a part of the leading air returned from the scavenging port in this way, and such a part of the leading air stays in the piston groove to reduce the blow-back to the intake port.

SUMMARY

The stratified scavenging engine described in JP 4286679 B2 has a protrusion protruding from the bottom face of the piston groove. This protrusion blocks not only the blow-back of the leading air to the intake port but also the leading air during introduction from the intake port to the scavenging port. In this way although the protrusion suppresses the blow-back of the leading air, it fails to guide the leading air smoothly to the scavenging port. This stratified scavenging engine therefore fails to suppress blow-by of air-fuel mixture due to such a decrease in the leading air, and so fails to reduce THC sufficiently.

In view of the above problems, the present invention provides a stratified scavenging engine and a portable work machine that suppress THC sufficiently.

A stratified scavenging engine according to the present invention includes: a cylinder having a cylinder bore; and a piston stored in the cylinder bore to be movable in a reciprocating manner. The cylinder has an intake port to intake leading air and a scavenging port to scavenge combustion gas, the intake port and the scavenging port being open to the cylinder bore. The piston has a peripheral surface including a piston groove to guide leading air from the intake port to the scavenging port, and the piston groove has a recess near the intake port.

In a preferable aspect, the piston groove has a bottom face, and the recess is formed on the bottom face near the intake port.

In another preferable aspect, the piston groove has a first border and a second border as a pair on the bottom face with the peripheral face of the piston, and the recess is formed in a predetermined range from the first border near the intake port as an origin.

In another preferable aspect, the recess has a deepest part that is close to the first border.

In another preferable aspect, the recess has an erected wall surface having a steep rising angle from the deepest part to the first border, and an inclined face having a gently rising angle from the deepest part to the second border.

In another preferable aspect, the recess has a depth from the first border to the deepest part that is 3.8% or more and 10.4% or less of a diameter of the piston.

In another preferable aspect, the intake port includes a pair of intake ports, the scavenging port includes at least a pair of scavenging ports corresponding to the pair of intake ports, and the piston groove includes a pair of piston grooves corresponding to the pair of intake ports.

In another preferable aspect, the cylinder includes an air-fuel mixture port to intake air-fuel mixture, the air-fuel mixture port being disposed below the pair of intake ports and being open to the cylinder bore, a part of the peripheral surface of the piston between the pair of piston grooves defines a block surface on an arc in plan view to block the air-fuel mixture port, and the distance between the opposed pair of recesses of the piston grooves is smaller than the length of a chord of the block surface.

In another preferable aspect, the scavenging port communicates with a crank chamber via a scavenging channel, and when viewed laterally, the scavenging channel is inclined while getting closer to the intake port from the crank chamber toward the cylinder bore.

A portable work machine according to the present invention includes the above-stated stratified scavenging engine, and a work mechanism to be driven by the stratified scavenging engine.

In the present invention, the piston groove includes a recess near the intake port. Leading air flowing from the intake port toward the piston groove hardly enters the recess, and leading air returning from the scavenging port to the piston groove easily enters the recess. The recess therefore does not interfere with the flow of the leading air from the intake port to the scavenging port, and so the stratified scavenging engine of the present invention sends leading air sufficiently to the scavenging ports. A part of the leading air returning from the scavenging port to the intake port enters the recess to generate a swirling flow, and this swirling flow increases the air pressure in the piston groove and so suppress the blow-back of the leading air to the intake port. In this way, the stratified scavenging engine of the present invention sends leading air smoothly to the scavenging ports, and suppresses blow-back of the leading air to the intake port. This keeps enough leading air for scavenging and reduces THC sufficiently.

BRIEF DESCRIPTION OF THE DRAWINGS

FIG. 5A shows the flow of leading air from the intake port to the scavenging port, and FIG. 5B shows the flow of leading air returning from the scavenging port to the intake port;

FIG. 6A shows the flow of leading air from the intake port to the scavenging port, and FIG. 6B shows the flow of leading air returning from the scavenging port to the intake port;

FIG. 7A shows the THC concentration, FIG. 7B shows the THC amount, FIG. 7C shows the engine power, and FIG. 7D shows the fuel consumption.

DETAILED DESCRIPTION

The following describes one embodiment of the present invention with reference to the drawings.

[Overall Configuration of Stratified Scavenging Engine 10]

Figure 1:
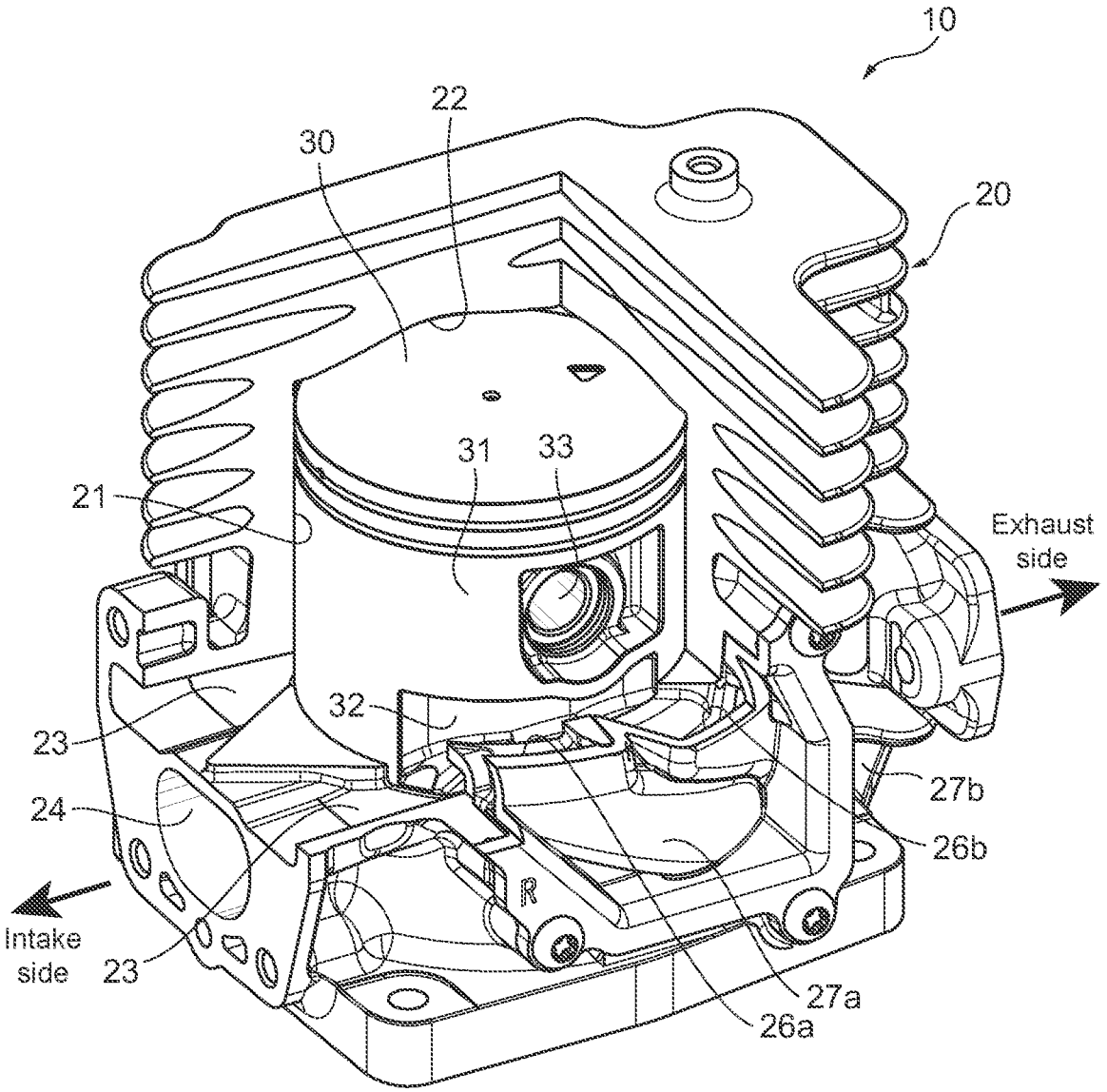
FIG. 1 is a perspective view of a stratified scavenging engine of the present embodiment.
Figure 2:
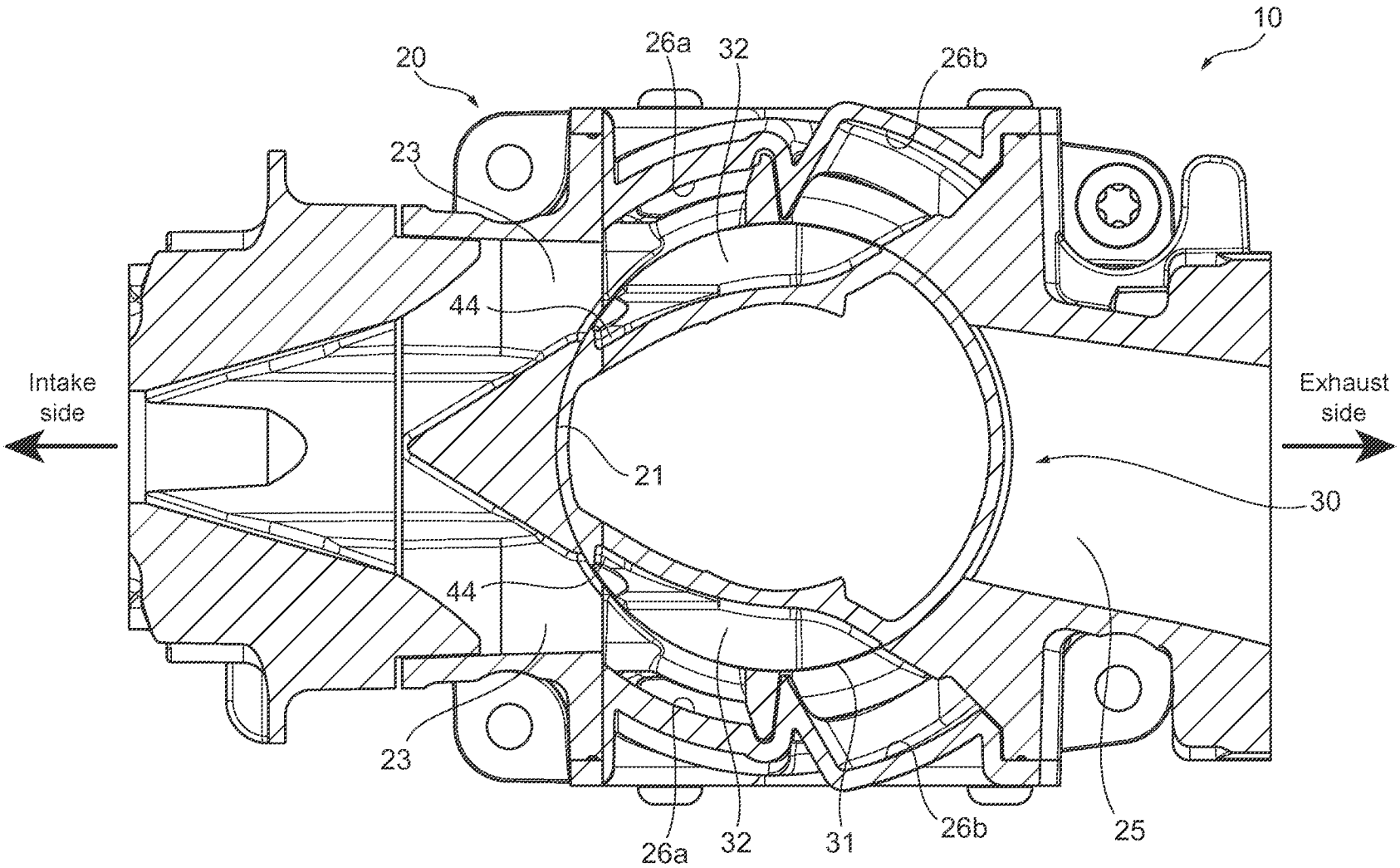
FIG. 2 is a transverse cross-sectional view of the stratified scavenging engine of the present embodiment.

FIG. 1 is a perspective view of a stratified scavenging engine of the present embodiment, and FIG. 2 is a transverse cross-sectional view of the stratified scavenging engine of the present embodiment.

As shown in FIG. 1 and FIG. 2, the stratified scavenging engine 10 is one type of a two-stroke engine, and is configured to let leading air firstly and air-fuel mixture secondly flow into a combustion chamber 22 in a stratified manner. In this way, this stratified scavenging engine 10 scavenges the combustion gas with the leading air to avoid blow-by of the unburned gas (air-fuel mixture). The stratified scavenging engine 10 includes a cylinder 20 attached on a crankcase (not illustrated). The cylinder 20 has a cylinder bore 21 to accommodate a piston 30 to be movable in a reciprocating manner. The inner wall of the cylinder 20 (inner wall of the cylinder bore 21) and the crown surface of the piston 30 define the combustion chamber 22 in the cylinder 20. The volume of the combustion chamber 22 changes with the reciprocating motion of the piston 30.

The crankcase has a crank chamber (not shown), and the piston 30 divides the crank chamber and the combustion chamber 22. The piston 30 has a peripheral surface 31, and a pair of piston grooves 32 is formed on the peripheral surface 31 for a channel of the leading air, which is described later in details. The piston 30 has a pin hole 33 on the peripheral surface 31, and a piston pin (not shown) inserted through the pin hole 33 connects the piston 30 with a crank shaft (not shown) via a connecting rod (not shown). The crank shaft connects to a work mechanism of a portable work machine so that the reciprocating motion of the piston 30 is transmitted to the work mechanism through the crank shaft.

A pair of intake ports 23 to intake the leading air, an air-fuel mixture port 24 to intake the air-fuel mixture, an exhaust port 25 to emit the combustion gas (see FIG. 2), and scavenging ports 26*a* and 26*b* to scavenge the combustion gas are open to the cylinder bore 21. The pair of intake ports 23 are disposed on the intake side of the cylinder 20, and the air-fuel mixture port 24 is disposed below the pair of intake ports 23. The exhaust port 25 is disposed on the exhaust side that is opposed to the intake ports 23 relative to the piston 30. The scavenging ports 26*a* and 26*b* are disposed in the left and right direction orthogonal to the intake-exhaust direction, and are opposed to each other relative to the piston 30. The scavenging ports 26*a* are on the intake side and the scavenging ports 26*b* are on the exhaust side.

These scavenging ports 26*a* and 26*b* communicate with the crank chamber via the scavenging channels 27*a* and 27*b*, respectively. The pair of piston grooves 32 correspond to the pair of intake ports 23 and the scavenging ports 26*a* and 26*b*, so that the leading air flowing into the pair of intake ports 23 are guided to the scavenging ports 26*a* and 26*b* via the pair of piston grooves 32. A part of the peripheral surface 31 of the piston 30 other than the piston grooves 32 defines a block surface to block these ports and channels. The reciprocating motion of the piston 30 opens and closes the pair of intake ports 23, the air-fuel mixture port 24, the exhaust port 25, and the scavenging ports 26*a* and 26*b*.

During ascending of the piston 30 of such a stratified scavenging engine 10 from the bottom dead center to the top dead center, the air-fuel mixture port 24 opens to the crank chamber and the intake ports 23 above the air-fuel mixture port 24 communicate with the piston grooves 32 of the piston 30. Subsequently the piston grooves 32 communicate with the scavenging ports 26*a* and 26*b* so that the leading air flows into the downstream (close to the combustion chamber 22) of the scavenging channels 27*a*, 27*b* from the scavenging ports 26*a*, 26*b*, and the air-fuel mixture flows into the upstream (close to the crank chamber) of the scavenging channels 27*a*, 27*b* from the crank chamber. This fills the downstream of the scavenging channels 27*a*, 27*b* with the leading air and fills the upstream of the scavenging channels 27*a*, 27*b* with the air-fuel mixture. During scavenging of the combustion gas, the leading air firstly flows into the combustion chamber 22, so as to avoid blow-by of the air-fuel mixture.

[Structure of Piston 30]

Figure 3:
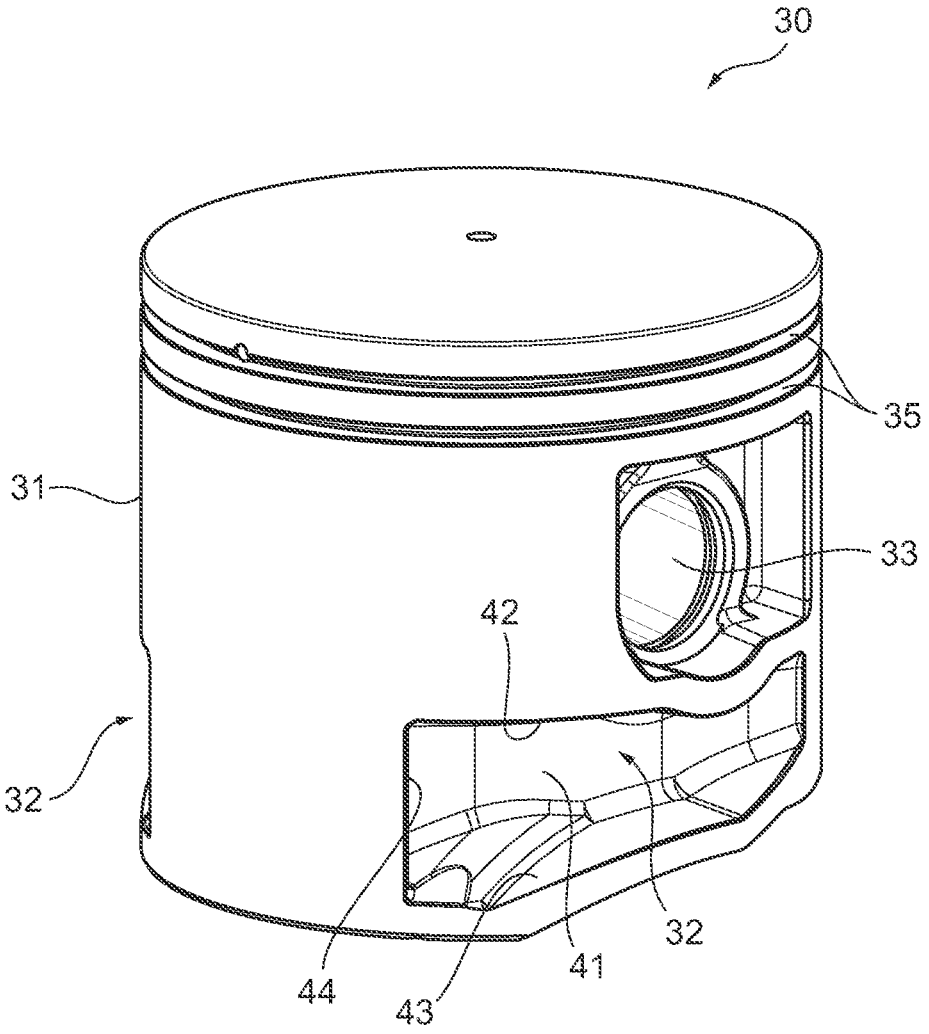
FIG. 3 is a perspective view of a piston of the present embodiment.
Figure 4:
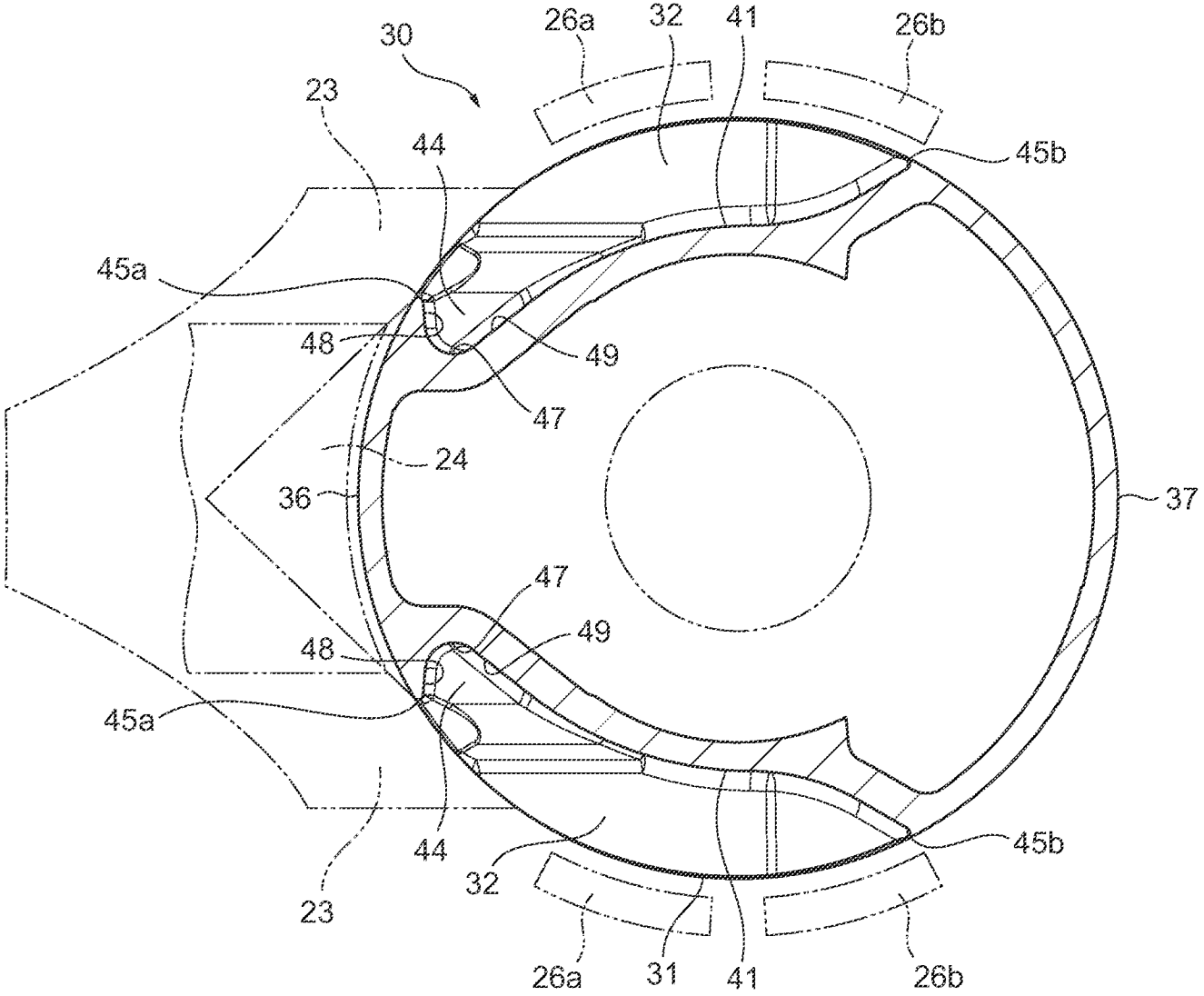
FIG. 4 is a transverse cross-sectional view of the piston of the present embodiment.

FIG. 3 is a perspective view of a piston of the present embodiment, and FIG. 4 is a transverse cross-sectional view of the piston of the present embodiment.

As shown in FIG. 3 and FIG. 4, a pair of upper and lower piston rings 35 is attached to the peripheral surface 31 of the piston 30 near the upper end. These piston rings 35 keep the airtightness in the cylinder bore 21. The piston 30 has the pair of piston grooves 32 on the peripheral surface 31 near the lower end, and the pair of piston grooves 32 guide the leading air from the pair of intake ports 23 to the scavenging ports 26*a* and 26*b*. The piston 30 has the pin hole 33 between the piston rings 35 and the pair of piston grooves 32, and the pin hole 33 is connected to the connecting rod via the piston pin as stated above. The piston 30 has a hollow inside for lighter weight, and a part of the piston 30 to support the piston pin, for example, is partially reinforced.

Each piston groove 32 extends from around the intake port 23 to around the scavenging port 26*b* on the exhaust side. This means that the distance between the piston grooves 32 as a pair on the peripheral surface 31 is narrower on the intake side of the piston 30 and is wider on the exhaust side of the piston 30. A part of the peripheral surface 31 of the piston 30 on the intake side and between the pair of piston grooves 32 defines a block surface 36 to block the air-fuel mixture port 24, and a part of the peripheral surface 31 of the piston 30 on the exhaust side and between the pair of piston grooves 32 defines a block surface 37 to block the exhaust port 25. Each piston groove 32 has the bottom face 41, the upper side face 42 and the lower side face 43 to define an angular U-letter shaped groove on the peripheral surface 31 of the piston 30.

The bottom face 41 of each of the piston grooves 32 as a pair has a recess 44 near the corresponding intake port 23 so as not to interfere with supplying of the leading air to the scavenging ports 26*a*, 26*b*. The recess 44 suppresses blow-back of the leading air to the intake port 23, and generates a swirling flow V (see FIG. 6B) in the leading air returning from the scavenging port 26*a*, 26*b* to the piston groove 32. As described later in details, such a swirling flow V due to the recess 44 of the piston groove 32 near the intake port 23 increases the air pressure in the piston groove 32 so as to suppress the blow-back of the leading air to the intake port 23.

The distance between these opposed recesses 44 as a pair is smaller than the length of the chord of the block surface 36 on the arc in plan view. This means that each recess 44 has a recessed-shape that is partially deep on the bottom face 41 of the piston groove 32 near the intake port 23. Each piston groove 32 has a pair of borders 45*a* and 45*b* on the bottom face 41 with the peripheral face 31 of the piston 30. The recess 44 is formed in a predetermined range from the border 45*a* near the intake port 23 as the origin. In the shown example, the recess 44 reaches a substantially half part of the bottom face 41 of the piston groove 32. This forms the recess 44 so as to be closer to the intake port 23.

More specifically the recess 44 has a deepest part 47 that is close to one border 45*a*. The wall surface from the deepest part 47 toward the border 45*a* is an erected wall surface 48 having a steep rising angle (about 90-degree). Whereas the wall surface from the deepest part 47 toward the other border 45*b* is an inclined face 49 having a gently rising angle (about 30-degree). These steep and gently rising angles indicate the inclinations relative to the tangential direction of the deepest part 47 (intake and exhaust direction where the intake port 23 and the exhaust port 25 are opposed). The inclined face 49 of the recess 44 gently continues to the bottom face 41 of the piston groove 32, and defines a guide face of the leading air that returns from the scavenging ports 26*a*, 26*b* to the intake port 23.

The present embodiment describes just one example having the recess 44 on the bottom face 41 of the piston groove 32. In another example, the recess 44 may be formed on at least one of the bottom face 41, the upper side face 42 and the lower side face 43 of the piston groove 32 near the intake port 23 as long as the recess 44 is in the piston groove 32 near the intake port 23. Such a recess 44 formed on the upper side face 42 or the lower side face 43 of the piston groove 32 and not on the bottom face 41 also generates a swirling flow V in the piston groove 32 near the intake port 23.

[Flow of Leading Air in Piston Groove 32]

Figure 5A:
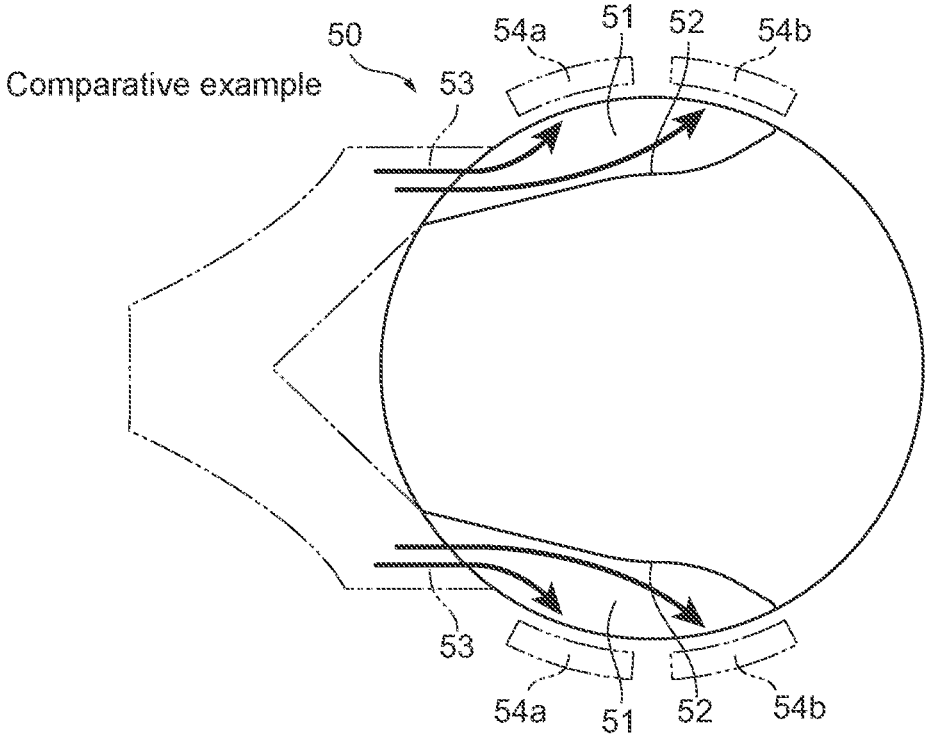
FIGS. 5A and 5B show the flow of leading air in the piston groove in comparative example, where
Figure 5B:
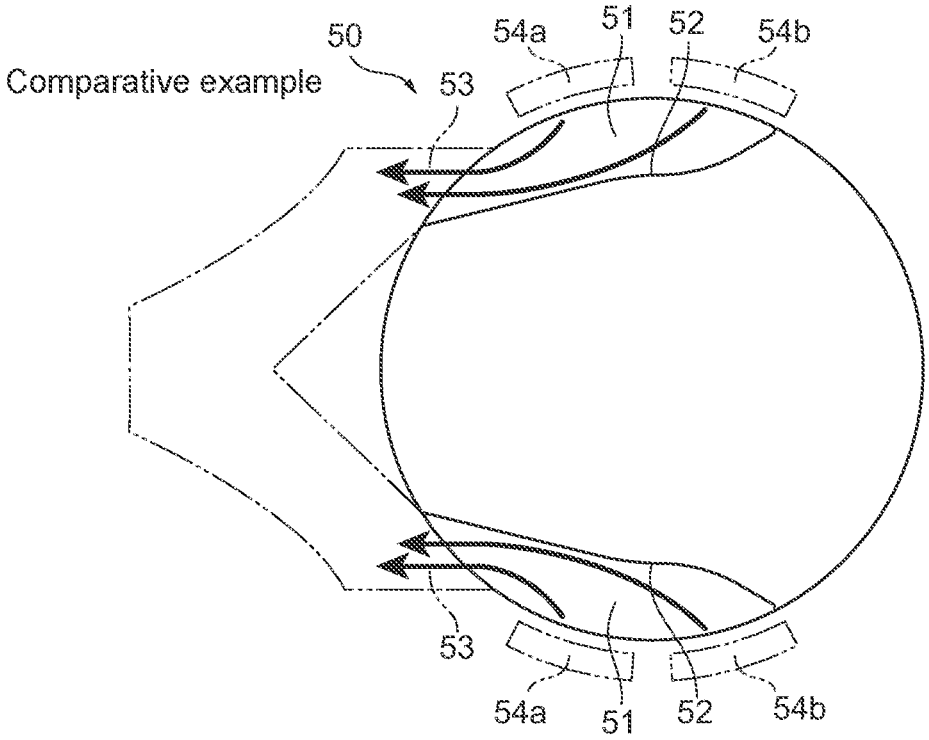
Figure 6A:
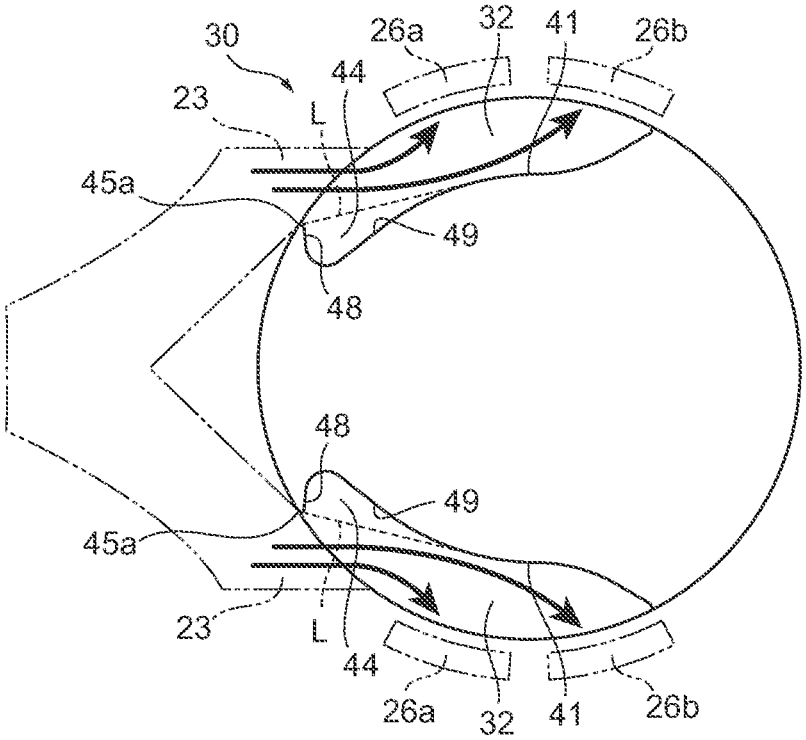
FIGS. 6A and 6B show the flow of leading air in the piston groove in the present embodiment, where
Figure 6B:
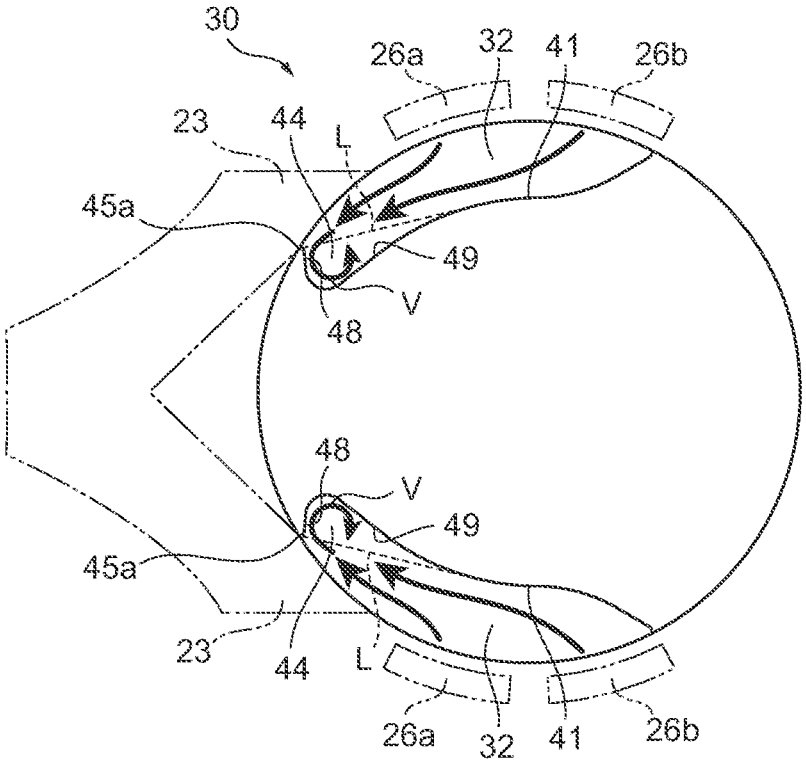

Referring to FIGS. 5A and 5B, the following firstly describes a comparative example showing a typical piston groove, followed by descriptions on the present embodiment referring to FIGS. 6A and 6B. FIGS. 5A and 5B show the flow of leading air in the piston groove in the comparative example. FIGS. 6A and 6B show the flow of leading air in the piston groove in the present embodiment. FIG. 5A and FIG. 6A show the flow of leading air from the intake port to the scavenging port, and FIG. 5B and FIG. 6B show the flow of leading air that returns from the scavenging port to the intake port.

As shown in FIG. 5A, the piston 50 in the comparative example is different from the piston 30 of the present embodiment in that each of the piston grooves 51 as a pair does not have a recess on the bottom face 52. Ascending of the piston 50 allows leading air to be sent from the intake ports 53 as a pair to the scavenging ports 54*a* and 54*b* via the pair of piston grooves 51. The leading air flowing into the scavenging ports 54*a* and 54*b* scavenges the combustion gas, and this suppresses blow-by of the air-fuel mixture. Descending of the piston 50 as shown in FIG. 5B, however, allows the leading air to return from the scavenging ports 54*a* and 54*b* to the pair of piston grooves 51, and this causes blow-back to the intake ports 53.

On the contrary, as shown in FIG. 6A, the piston 30 in the present embodiment has the recess 44 on the bottom face 41 of each of the piston grooves 32 as a pair near the intake port 23. This recess 44 is recessed more than the bottom face 52 (see FIG. 5A) of the piston groove 51 of the comparative example indicated with the broken line L, i.e., than the bottom face having a streamline shape. Ascending of the piston 30 allows leading air to be sent from the intake ports 23 as a pair to the scavenging ports 26*a* and 26*b* via the pair of piston grooves 32. Due to the steep erected wall surface 48 from the border 45*a* to the recess 44, leading air from the intake port 23 hardly enters the recess 44. Instead, leading air is smoothly guided from the pair of intake ports 23 to the scavenging ports 26*a* and 26*b*.

As shown in FIG. 6B, descending of the piston 30 allows the leading air to return from the scavenging ports 26*a* and 26*b* to the pair of piston grooves 32. A part of the returning leading air is guided along the inclined face 49 of the recess 44 to the erected wall face 48 to collide with the erected wall face 48. This generates a swirling flow V around the recess 44 of the piston groove 32. This swirling flow V increases the air pressure in the piston groove 32 near the intake port 23, and so suppresses the blow-back of the leading air to the intake port 23. In this way, the present embodiment sends leading air smoothly to the scavenging ports 26*a* and 26*b*, and suppresses blow-back of the leading air. This keeps enough leading air for scavenging and reduces THC sufficiently.

When viewed laterally, the scavenging channel 27*a*, 27*b* of the present embodiment is inclined while getting closer to the intake port 23 from the crank chamber located below the cylinder 20 toward the cylinder bore 21 (see FIG. 1). Such inclination of the scavenging channel 27*a*, 27*b* makes it easy to suck the leading air from the piston groove 32 to the scavenging channel 27*a*, 27*b* during ascending of the piston 30, but makes it easy for the leading air charged in the scavenging channel 27*a*, 27*b* to return to the piston groove 32 during descending of the piston 30. Even with such a scavenging channel 27*a,* 27*b,* the recess 44 on the bottom face 41 of the piston groove 32 generates a swirling flow V near the intake port 23, and so suppresses blow-back of the leading air to the intake port 23.

Such a stratified scavenging engine 10 may be included in a portable work machine (not shown), such as a power blower, a brush cutter, or a chain saw. Such a portable work machine includes a work mechanism, such as a fan, a blade, or a saw chain, that is driven by the stratified scavenging engine 10. This work mechanism connects to the output shaft, such as the crank shaft of the stratified scavenging engine 10, and is driven by the reciprocating motion of the piston 30 in the cylinder 20. The portable work machine including the stratified scavenging engine 10 as stated above reduces THC and so meets the need for environmental protection.

[Experiments]

Figure 7A:
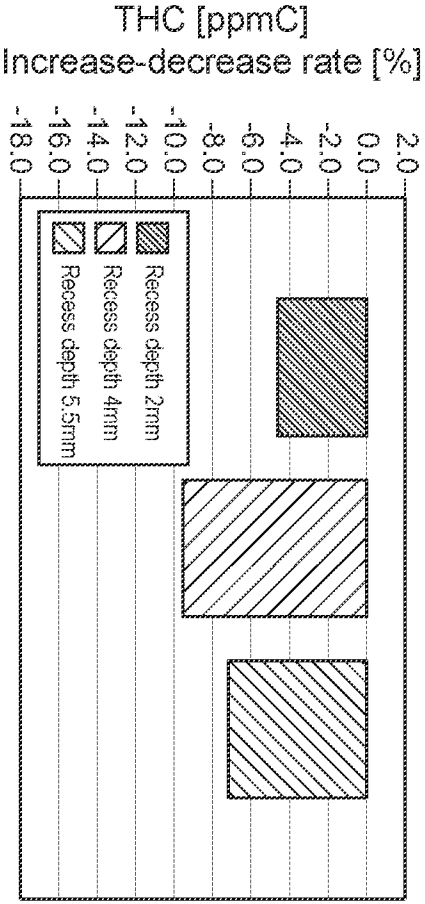
FIGS. 7A to 7D show graphs of various specification during peak power, where
Figure 7B:
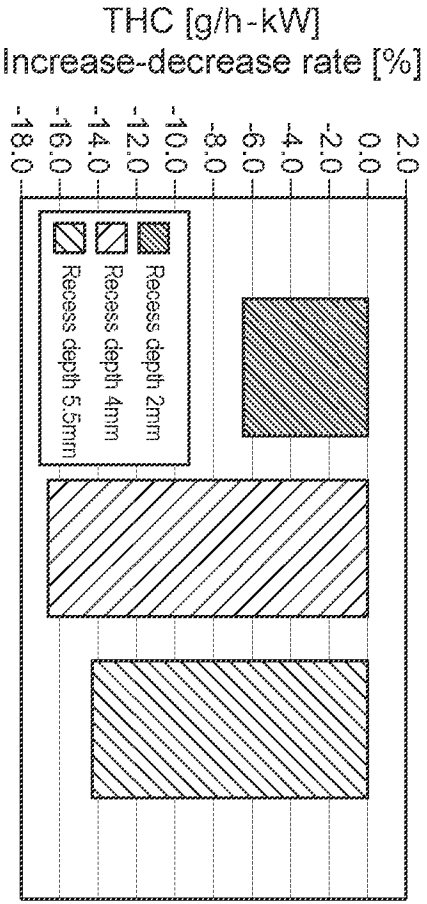
Figure 7C:
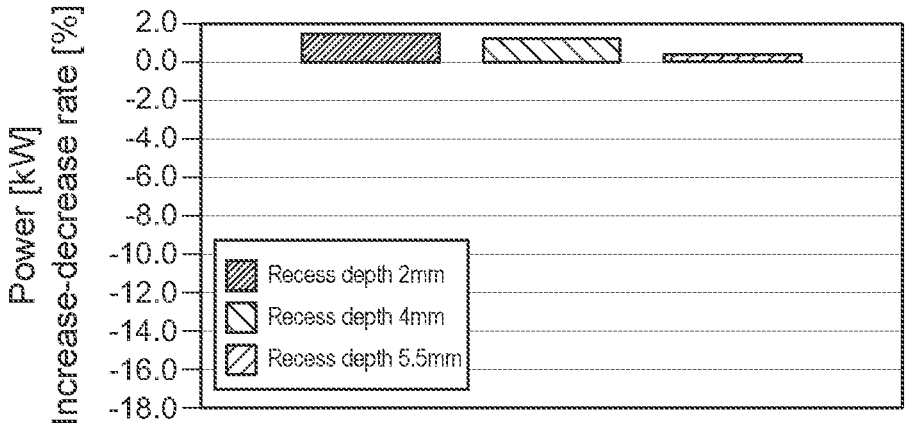
Figure 7D:
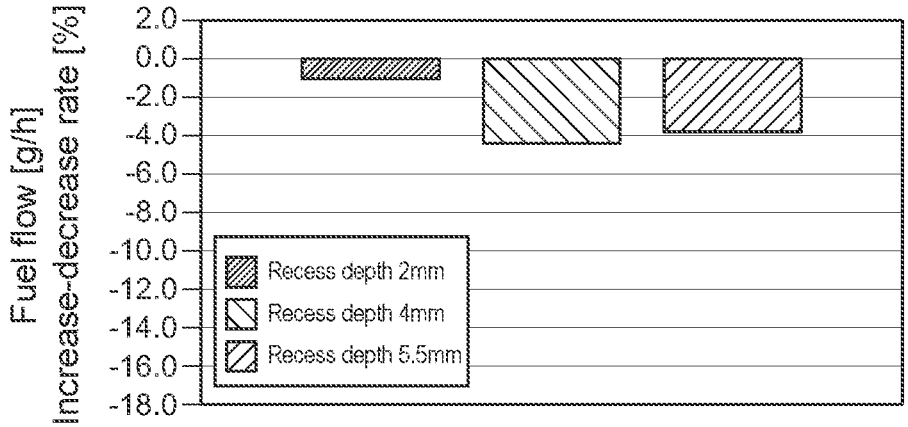
Figure 8:
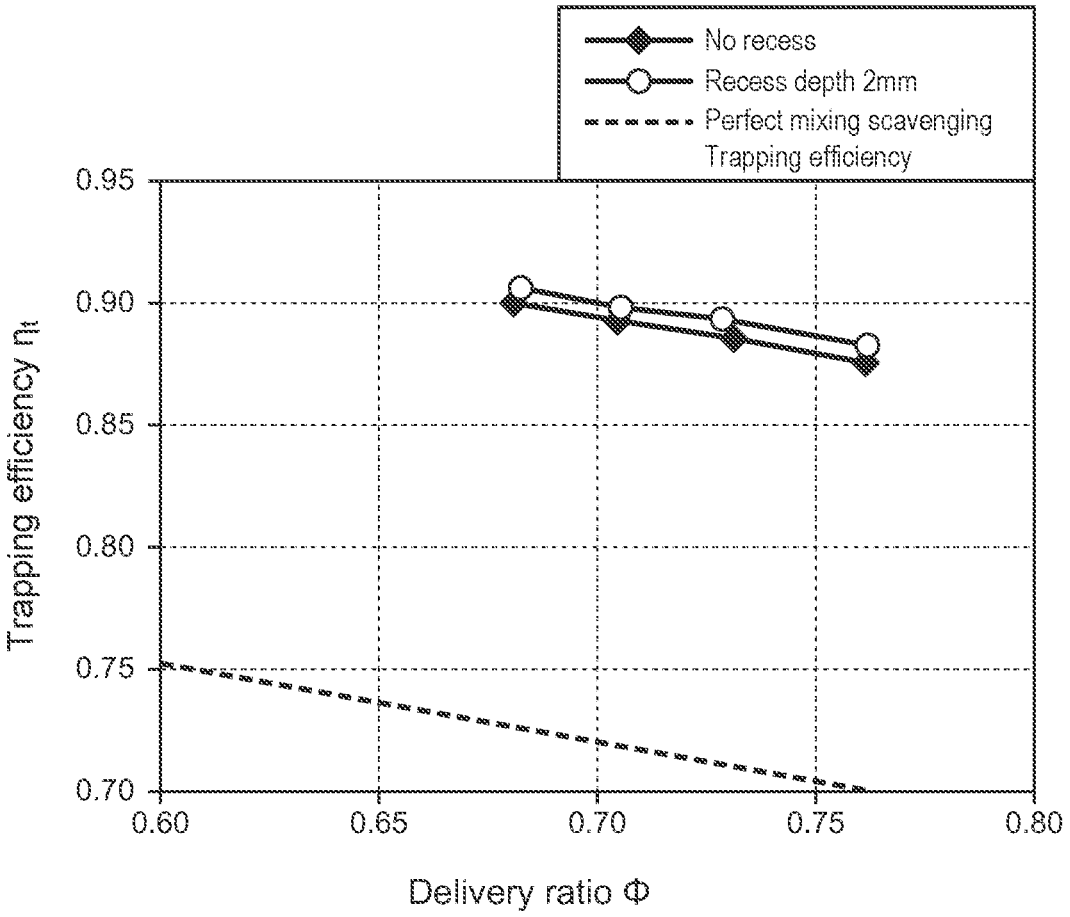
FIG. 8 is a graph of the relationship between the delivery ratio and the trapping efficiency.

Next the following describes an example of experiments. FIGS. 7A to 7D show graphs of various specifications during peak power. FIG. 8 is a graph of the relationship between the delivery ratio and the trapping efficiency. FIG. 7A shows the THC concentration, FIG. 7B shows the THC amount, FIG. 7C shows the engine power, and FIG. 7D shows the fuel consumption.

Pistons having the recesses of 0 mm (no recess), 2 mm, 4 mm, and 5.5 mm in depth and of 53 mm in diameter were prepared. For these pistons, the THC concentration [ppmC], the THC amount [g/h-kW], the engine power [kW], and the fuel consumption [g/h] were measured with the engine revolutions corresponding to peak power. Then, increase-decrease rates of the measurements for the THC concentration, the THC amount, the engine power and the fuel consumption with the pistons having the recess depths of 2 mm, 4 mm, and 5.5 mm were calculated relative to the measurements with the piston without recess (see FIGS. 5A and 5B). Note here that the depth of the recess 44 refers to a linear distance from the border 45*a* to the deepest part 47 of the recess 44 in the piston 30 (see FIG. 4).

As shown in FIG. 7A, the THC concentration with the pistons having the recess depths of 2 mm, 4 mm, and 5.5 mm decreased by about 4.0%, about 10.0%, and about 7.0%, respectively, from the THC concentration with the piston without recess. As shown in FIG. 7B, the THC amount with the pistons having the recess depths of 2 mm, 4 mm, and 5.5 mm decreased by about 6.0%, about 17.0%, and about 14.0%, respectively, from the THC amount with the piston without recess. This shows that the recesses reduce THC more. Note here that when the depth of the recess exceeds 4 mm, the decrease amount of THC slightly reduces.

As shown in FIG. 7C, the engine power with the pistons having the recess depths of 2 mm, 4 mm, and 5.5 mm increased by about 1.0%, about 1.0%, and about 0.5%, respectively, from the engine power with the piston without recess. This shows that the recess depth in the range of 2 mm to 5.5 mm does not affect the engine power. As shown in FIG. 7D, the fuel consumption with the pistons having the recess depths of 2 mm, 4 mm, and 5.5 mm improved by about 1.0%, about 4.0%, and about 4.0%, respectively, from the fuel consumption with the piston without recess. Note here that the fuel consumption with the piston having the recess depth of 5.5 mm slightly decreased from the fuel consumption with the piston having the recess depth of 4.0 mm. This shows that the recesses improve the fuel consumption. The above experiments show that the recess depth is preferably 3.8% or more and 10.4% or less of the piston diameter to reduce THC, and is preferably 7.5% to decrease THC more and improve the fuel consumption.

FIG. 8 shows a comparison for the delivery ratio versus the trapping efficiency between the operation with the piston without recess (see FIGS. 5A and 5B) and the operation with the piston with the recesses of 2 mm in depth. The result shows that the trapping efficiency of the operation with the piston with the recess of 2 mm in depth improved by about 0.7% than that of the operation with the piston without recess. The delivery ratio is obtained by dividing the mass of air supplied during one cycle by the volume of the air occupying the engine displacement. A larger delivery ratio means a higher power. The trapping efficiency is the usage efficiency of the supplied air. A larger trapping efficiency means less blow-by of air-fuel mixture and so decreases THC more.

Although not shown, a comparison of the stratification effect during scavenging by leading air was made between the operation with the piston without the recess and the operation with the piston with the recess of 2 mm in depth. The stratification effect is calculated, for example, by dividing the ratio of the amount of blow-by of air-fuel mixture to the overall blow-by amount by the ratio of the amount of blow-by of leading air to the overall blow-by amount. The result shows that the stratification effect from the operation with the piston with the recess depth of 2 mm improved by about 8% than that from the operation with the piston without recess. The stratification effect increases with an increase in the amount of leading air during scavenging, and a large stratification effect means a thicker layer of the leading air, and so suppresses blow-by of air-fuel mixture more.

As described above, the stratified scavenging engine 10 of the present embodiment has the recess 44 in each of the piston grooves 32 near the intake port 23. Leading air flowing from the intake port 23 to the piston groove 32 hardly enters the recess 44, and leading air returning from the scavenging port 26*a,* 26*b* to the piston groove 32 easily enters the recess 44. The recess 44 therefore does not interfere with the flow of the leading air from the intake port 23 to the scavenging port 26*a,* 26*b,* and so the stratified scavenging engine 10 of the present embodiment sends leading air sufficiently to the scavenging ports 26*a* and 26*b*. A part of the leading air returning from the scavenging port 26*a,* 26*b* to the intake port 23 enters the recess 44 to generate a swirling flow V, and this swirling flow V increases the air pressure in the piston groove 32 and so suppress the blow-back of the leading air to the intake port 23. In this way, the present embodiment sends leading air smoothly to the scavenging ports 26*a* and 26*b,* and suppresses blow-back of the leading air to the intake port 23. This keeps enough leading air for scavenging and reduces THC sufficiently.

The present embodiment describes the structure including a pair of piston grooves on the peripheral surface of the piston as just one example. In another structure, the piston may have a single piston groove on the peripheral surface, or may have three or more piston grooves on the peripheral surface.

The present embodiment describes the structure including a pair of intake ports for a pair of piston grooves as just one example. In another structure, a single intake port may communicate with a pair of piston grooves.

The present embodiment describes the structure having a single recess on the bottom face of the piston groove near the intake port as just one example. In another structure, the piston groove may have a plurality of recesses near the intake port.

The present embodiment describes the structure having four scavenging ports as just one example. In another structure having a single piston groove on the peripheral surface, the piston may have a single scavenging port.

The present embodiment describes the structure including a recess formed in a predetermined range from one of the borders of the piston groove as just one example. As long as such a recess is near the intake port of the piston groove, the recess may generate a swirling flow in the piston groove near the intake port.

The present embodiment describes the structure including a recess uniformly formed in the groove width direction on the bottom face of the piston groove. In another structure, the piston may have a recess at a part in the groove width direction on the bottom face of the piston groove.

That is the descriptions on the present embodiment. In another embodiment, the above-stated embodiment may be entirely or partially combined with a modified example of the embodiment.

The techniques of the present invention is not limited to the above embodiment, and may be variously changed, replaced, or modified without departing from the spirit of the technical idea. If the technical idea can be embodied in other ways by technological advancement or another technology derived therefrom, the present invention may be implemented using the method. The claims cover all of the embodiments that can be included within the scope of the technical idea.

DESCRIPTION OF SYMBOLS

10 Stratified scavenging engine
20 Cylinder
21 Cylinder bore
23 Intake port
24 Air-fuel mixture port
26*a* Scavenging port
26*b* Scavenging port
27*a* Scavenging channel
27*b* Scavenging channel
30 Piston
31 Peripheral surface
32 Piston groove
36 Block surface
41 Bottom face
44 Recess
45*a* Border
45*b* Border
47 Deepest part
48 Erected wall surface
49 Inclined face

What is claimed is:

1. A stratified scavenging engine comprising: a cylinder having a cylinder bore; and a piston stored in the cylinder bore to be movable in a reciprocating manner, the cylinder having an intake port to intake leading air and a scavenging port to scavenge combustion gas, the intake port and the scavenging port being open to the cylinder bore, wherein the piston has a peripheral surface defining a piston wall, the piston including an arcuate piston groove to guide leading air from the intake port to the scavenging port, the arcuate piston groove has a semi-circular recess near the intake port, and wherein the semi-circular recess has an apex at a deepest part relative to the peripheral surface and the deepest part being most proximal to a first border, and wherein a portion of the piston wall extends away from the apex towards the peripheral surface thereby blocking airflow through the semi-circular recess.

2. The stratified scavenging engine according to claim 1, wherein the arcuate piston groove has a bottom face, and the semi-circular recess is formed on the bottom face near the intake port.

3. The stratified scavenging engine according to claim 2, wherein the arcuate piston groove has a first border and a second border as a pair on the bottom face with the peripheral face of the piston, and the semi-circular recess is formed in a predetermined range from the first border near the intake port as an origin.

4. The stratified scavenging engine according to claim 3, wherein the semi-circular recess has an erected wall surface having a steep rising angle from the deepest part to the first border, and an inclined face having a gently rising angle from the deepest part to the second border.

5. The stratified scavenging engine according to claim 4, wherein the semi-circular recess has a depth from the first border to the deepest part that is 3.8% or more and 10.4% or less of a diameter of the piston.

6. The stratified scavenging engine according to claim 1, wherein the intake port includes a pair of intake ports, the scavenging port includes at least a pair of scavenging ports corresponding to the pair of intake ports, and the arcuate piston groove includes a pair of arcuate piston grooves corresponding to the pair of intake ports.

7. The stratified scavenging engine according to claim 6, wherein the cylinder includes an air-fuel mixture port to intake air-fuel mixture, the air-fuel mixture port being disposed below the pair of intake ports and being open to the cylinder bore, a part of the peripheral surface of the piston between the pair of arcuate piston grooves defines a block surface on an arc in plan view to block the air-fuel mixture port, and the distance between the opposed pair of semi-circular recesses of the arcuate piston grooves is smaller than the length of a chord of the block surface.

8. The stratified scavenging engine according to claim 1, wherein the scavenging port communicates with a crank chamber via a scavenging channel, and when viewed laterally, the scavenging channel is inclined while getting closer to the intake port from the crank chamber toward the cylinder bore.

9. A portable work machine comprising the stratified scavenging engine according to claim 1, and a work mechanism to be driven by the stratified scavenging engine.

* * * * *